US008065801B2

(12) United States Patent
Royle et al.

(10) Patent No.: US 8,065,801 B2
(45) **Date of Patent: *Nov. 29, 2011**

(54) ELECTRIC RAZOR ASSEMBLY

(75) Inventors: Terence Gordon Royle, Oakley (GB); Luke David Blyth, Spalding (GB)

(73) Assignee: The Procter & Gamble Company, Cincinnati, OH (US)

( * ) Notice: Subject to any disclaimer, the term of this patent is extended or adjusted under 35 U.S.C. 154(b) by 415 days.

This patent is subject to a terminal disclaimer.

(21) Appl. No.: 11/815,996

(22) PCT Filed: Feb. 9, 2006

(86) PCT No.: PCT/GB2006/000464

§ 371 (c)(1),
(2), (4) Date: Sep. 23, 2008

(87) PCT Pub. No.: WO2006/085086

PCT Pub. Date: Aug. 17, 2006

(65) Prior Publication Data

US 2009/0100680 A1 Apr. 23, 2009

(30) Foreign Application Priority Data

Feb. 11, 2005 (GB) ..... 0502936.8

(51) Int. Cl.
*B26B 21/22* (2006.01)

(52) U.S. Cl. ..... 30/43.92; 30/50; 30/43.6

(58) Field of Classification Search ..... 30/43.92, 30/50, 43.6, 49

See application file for complete search history.

(56) References Cited

U.S. PATENT DOCUMENTS

| | | | | |
|---|---|---|---|---|
| 3,436,822 | A | 4/1969 | Heyek | |
| 3,768,348 | A | 10/1973 | Braun et al. | |
| 3,881,373 | A | 5/1975 | Nakamura et al. | |
| 4,516,320 | A | 5/1985 | Peleckis | |
| 4,854,043 | A | 8/1989 | Chen | |
| 4,976,028 | A | 12/1990 | Chen | |
| 5,473,818 | A | 12/1995 | Otsuka et al. | |
| 6,158,125 | A * | 12/2000 | Dolev | 30/43.6 |
| 6,772,523 | B1 * | 8/2004 | Richard et al. | 30/527 |
| 6,804,886 | B2 * | 10/2004 | Wain | 30/49 |
| 7,024,776 | B2 * | 4/2006 | Wain | 30/50 |
| 7,131,203 | B2 * | 11/2006 | Wain | 30/57 |
| 7,464,471 | B2 * | 12/2008 | Fukutani et al. | 30/43.91 |

(Continued)

FOREIGN PATENT DOCUMENTS

| | | |
|---|---|---|
| DE | 40 03 578 | 2/1990 |

(Continued)

*Primary Examiner* — Boyer D Ashley
*Assistant Examiner* — Omar Flores Sanchez
(74) *Attorney, Agent, or Firm* — Brent M. Peebles; Kim William Zerby

(57) ABSTRACT

A electric razor foil assembly comprises flexible outer and inner foils (1, 2) supported by a structure (14) that is deformable to permit the foils to flex to follow concave or convex curvatures. The support structure includes two suspension members (22) supporting the foils along the respective side edges, and each support member (22) has several support elements (24) interconnected by hinges (25) and in sliding cooperation with the foils. The deformation of the suspension members is guided by guide plates located adjacent the suspension members. The foils are urged into cooperation by spring members (30) and the inner foil (2) is reciprocated by a drive arrangement including a flexible drive plate (36) disposed between the spring members (30) and the inner foil (2).

27 Claims, 6 Drawing Sheets

U.S. PATENT DOCUMENTS 7,721,446 B2 * 5/2010 Royle ..... 30/49

FOREIGN PATENT DOCUMENTS

| | | |
|---|---|---|
| EP | 0267044 | 1/1990 |
| EP | 1 449 627 | 8/2004 |
| EP | 1 454 720 | 9/2004 |
| GB | 1189717 | 4/1970 |
| GB | 2 425 277 | 10/2006 |
| JP | 09183532 | 7/1997 |
| JP | 11019344 | 1/1999 |

* cited by examiner

ELECTRIC RAZOR ASSEMBLY

CROSS-REFERENCE TO RELATED APPLICATIONS

This application is a national phase of PCT/GB2006/00464, filed on Feb. 9, 2006, which claims priority from GB 0502936.8, filed on Feb. 11, 2005.

FIELD OF THE INVENTION

This invention is concerned with electric razors, and more especially with an assembly for an electric razor of the kind in which a foil is provided for contact with the skin being shaved and has openings to allow hairs to penetrate the foil in order to be severed by a shearing action between the foil and an inner member that is moved relative to the foil when the razor is in operation.

BACKGROUND OF THE INVENTION

There are known electric razors of the above kind in which the inner member that is driven relative to the outer, skin contacting foil, is a second foil with openings through which hairs can be inserted before being sheared between edges defined by the openings in the respective foils. A "foil" should be understood to have a thin sheet-like form, but a foil can be profiled and does not necessarily have constant thickness or a 'flat' shape. In another known construction the inner member is formed as a cutter with a series of spaced apart blade elements that define shearing edges that contact the outer foil, and the inner cutter is reciprocated relative to the foil so that the hairs extending through the foil openings and into the spaces between the blade elements are severed by being sheared by the shearing edges of the blade elements and the edges of the foil openings. With both known constructions the outer foil, for the most part, contacts the skin only over a limited area during shaving because the foil assembly is relatively stiff and is unable to conform to the undulations and curvatures generally present in skin areas that are traditionally shaved. As a consequence the efficiency of shaving is not as good as it might be and it takes longer to shave a body region than it would if there was better conformity between the foil of the razor and the skin surface. This drawback has been recognised and there have been attempts to produce more flexible foil structures. In EP-A-1449627 (Uchiyama), for example, there is described a foil assembly in which an outer foil is mounted in a casing and has a generally U-shaped cross-section, and an inner cutter has several upstanding cutter blades carried on a resilient elongate support, the cutter blades having convexly curved upper edges for cooperation with the inner surface of the foil. The elongate blade support is urged upwardly by springs positioned along its length to press the edges of the cutter blades against the foil. The resilient blade support is able to bend into convex and concave shapes under external forces being applied against the outer surface of the foil to deform the foil so that it assumes a curvature along its length. As a consequence an improved contact between the foil and a curved skin area is possible. However, as described in EP-A-1449627 with reference to FIG. 2 therein, the outer foil cutter (20) is fixed to the inside of the casing (22) at anchoring positions (24), and this inevitably reduces the flexing capabilities. Furthermore, the U-shaped foil configuration also acts to resist flexing of the foil along its length and, as the blade support bends the blades spread apart or come together so that distances separating the shearing edges of adjacent blades are changed and the shaving performance is consequently affected, which is undesirable. EP-A-1454720 describes a similar foil and cutter assembly but differs in that the inner cutter, instead of being resilient, is shaped so that the foil has a concave curvature along its length. A second foil and cutter assembly with a straight convex or concave configuration can be provided alongside the concave assembly. In this case, maintaining proper cooperation between the cutter blades and the foil over the full length of the foil becomes a problem when the inner cutter is reciprocated relative to the foil.

SUMMARY OF THE INVENTION

The present invention has for an object to at least alleviate the limitations of the prior art as explained above and to satisfy the need for an electric razor construction that can achieve improved contact and conformity between the outer foil and a curved skin contour.

Provided in accordance with the invention is an assembly in or for an electric razor, comprising an elongate flexible outer foil, the outer foil having openings to allow hairs to penetrate the foil, and a flexible inner cutter cooperating with and reciprocable relative to the outer foil for shearing hairs penetrating the outer foil, characterised in that the inner cutter is a foil, that the inner and outer foils are carried on a supporting structure that is deformable to permit the foils to flex, and that the supporting structure comprises a series of elements spaced apart along the foils and so linked together that the foils can flex to follow concave or convex curvatures along the length thereof.

With the inner member being a second flexible foil, close cooperation between the foils can be assured over their entire length and the cutting performance remains substantially constant irrespective of the flexing of the foils to conform to convex or concave skin curvatures. A support structure consisting of a series of spaced elements can provide effective foil support at a large number of points along the foils without seriously impairing the flexing capability of the foils. Preferably the number of supporting elements in the series is at least five, and ideally around 10 or more, and there can be as many as 20 or 25 Conveniently the foil support elements are uniformly spaced apart along the foils, and preferably the foil support elements are linked together by hinged connections and extend from the hinged connections to free ends at which the foils are supported. The outer foil is preferably slidably received by the support structure and in a simple but highly effective construction the foil support elements have notches at the free ends, and a side edge portion of the outer foil is received in and guided by the notches. Abutment faces provided on the supporting elements can support the inner foil against displacement away from the outer foil without interfering with movement of the inner foil which reciprocates relative to the supporting structure in operation of the razor. Movement of the outer foil is generally undesirable and the outer foil can conveniently be provided with a detent for engaging a foil support element to retain the outer foil against any longitudinal movement at the location of the engaged element. At least some movement in the longitudinal direction is permitted between the outer foil and other support elements so that flexing of the foil is not hindered. In order to minimise such relative movement the detent is preferably located at a medial position along the outer foil.

The inner foil can be reciprocally driven relative to the outer foil by any suitable driving system. A preferred drive mechanism, however, includes a flexible driving plate that is engaged with the inner foil, for example at a single location, such as at a medial position along the foil so that combined flexing of the driving plate and inner foil is not impeded by their driving interconnection. Thus, there is sliding cooperation between the inner foil and the driving plate except at the location of the point of driving engagement between them.

To control deformation of the foil supporting structure a guide arrangement is preferably included in the assembly for guiding relative movement of the linked foil support elements. The guide arrangement can include a frame in which the supporting structure is carried and at least two of the elements can be guided to move along linear paths. In particular two elements can be guided in the longitudinal direction and a further element can be guided in a direction substantially perpendicular to the longitudinal direction. In this way a symmetrical form can be maintained as the foils and the supporting structure flex and change curvature. Conveniently the guided elements have lateral projections that engage in guide slots formed in an adjacent frame member.

To assist in maintaining a close cooperation between the inner and outer foils the inner foil can be urged against the outer foil by one or more springs, such as several spring members that act on the inner foil at positions spaced apart along its length, and thereby an effective hair shearing action between the foils can be assured. In a particular embodiment the spring members are supported by respective foil supporting elements and carry rolling contact elements for supporting the inner foil to minimise frictional opposition to the foil reciprocation.

The presently preferred embodiment of the invention has a first series of linked supporting elements along one lateral edge of the foils and a second series of linked supporting elements along the other lateral edge of the foils. In this way a uniform support for the foils can be ensured by a symmetrical arrangement of the two series of linked supporting elements, and the above mentioned spring members can be conveniently positioned between and supported by respective pairs of laterally opposed supporting elements.

The or each of the series of linked foil supporting elements can take the form of a one piece foil suspension member whereby manufacture of the assembly is facilitated and assembly steps are reduced.

For reciprocating the inner foil a drive transmission coupled between the foil and a drive motor may include a slide member guided for linear movement, and an arm extending from the slide member to an upper end that is movable towards and away from the slide member to accommodate changes in the distance between the slide member and the foils when the foils flex. Such movement is conveniently permitted by a sliding connection between the arm and the slide member.

DESCRIPTION OF THE DRAWINGS

The foregoing and other features of the invention will be clearly understood from the following detailed description of the preferred embodiment, reference being made to the accompanying drawings in which:—

DETAILED DESCRIPTION OF THE EMBODIMENTS

Figure 1:
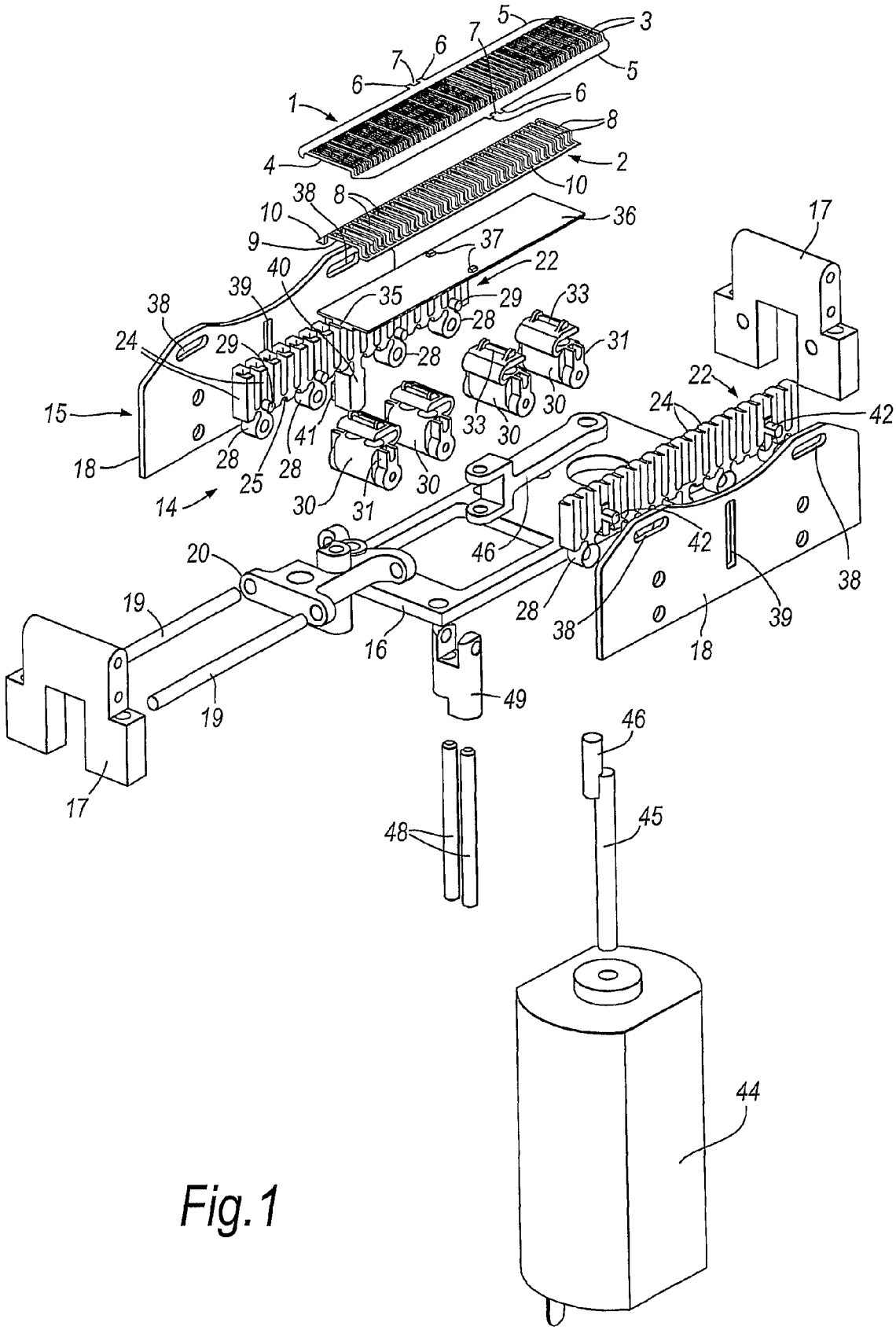
FIG. 1 is an exploded isometric view showing the main components of an electric razor assembly in accordance with the invention.
Figure 2:
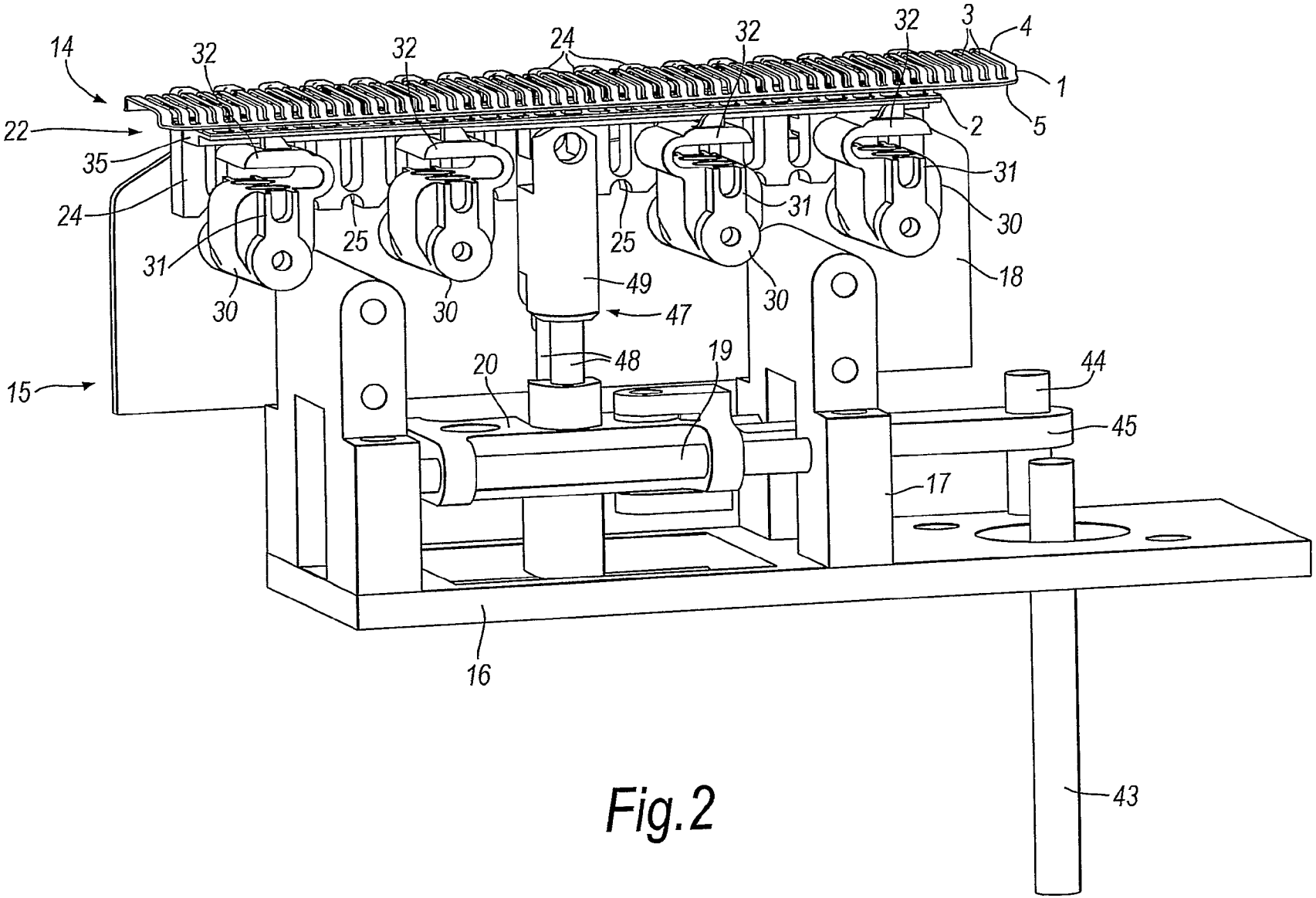
FIG. 2 is an isometric view of the assembly with some parts omitted for illustration purposes.
Figure 3:
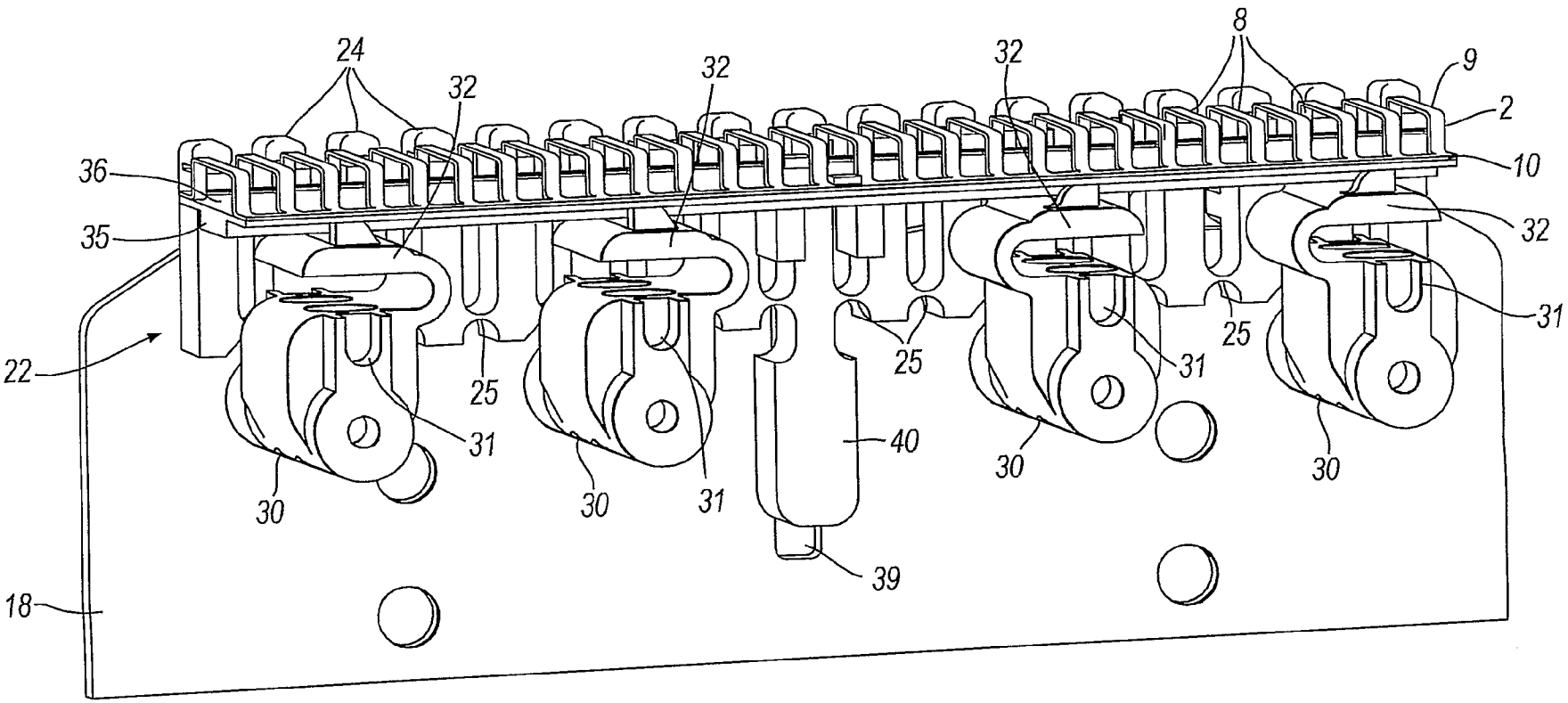
FIG. 3 is a view corresponding to FIG. 2 on a larger scale and with more parts omitted.
Figure 4:
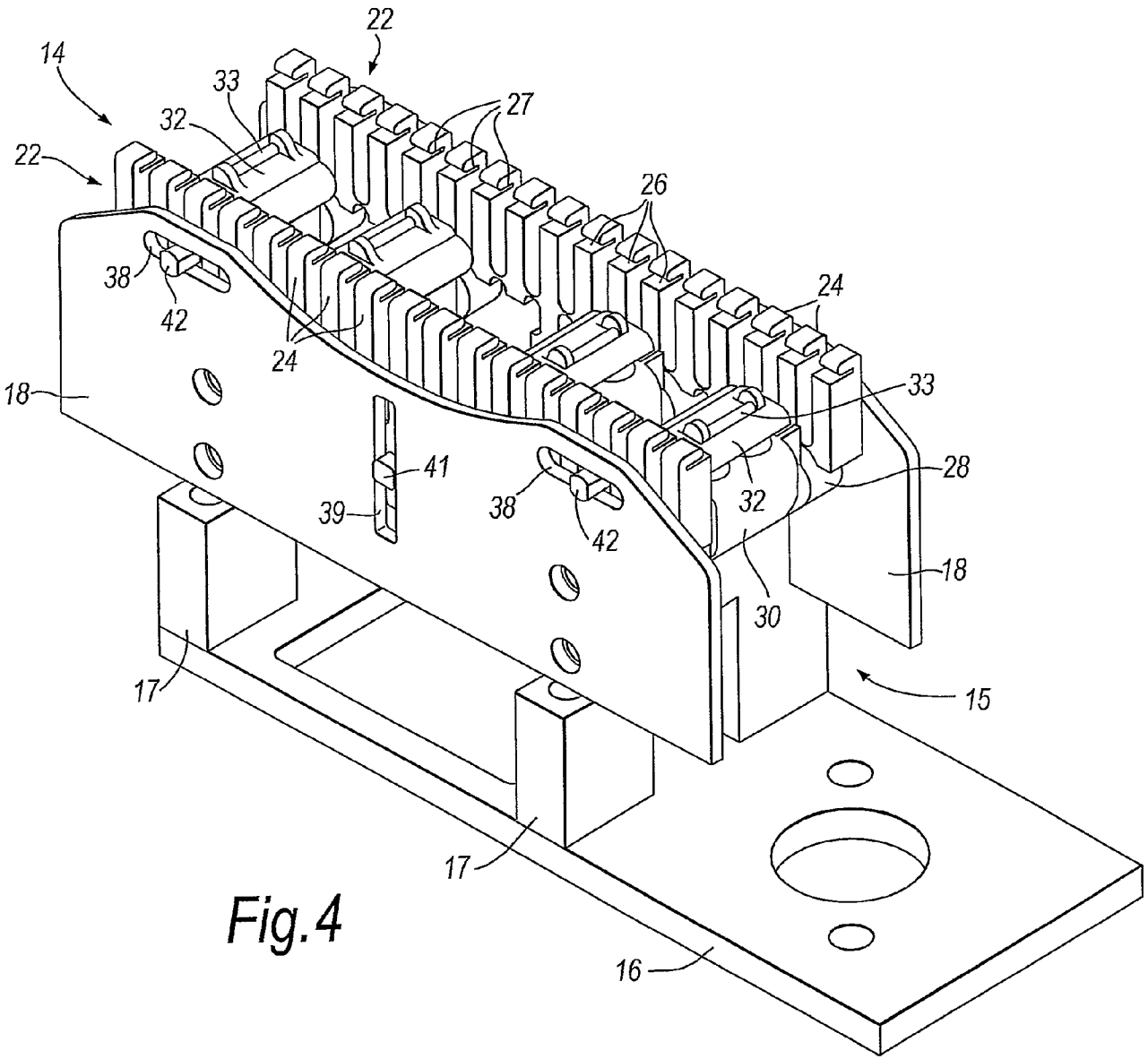
FIG. 4 is a an isometric view of the foil supporting structure.

The electric razor assembly illustrated in the drawings has an outer flexible foil 1 with an upper surface for contact with the skin during shaving, and a lower surface for engagement by an undercutter consisting of an inner flexible foil 2. The outer foil has a shallow stepped profile with a main central part 4 that has openings 3 for hairs to be cut to pass through the foil, and lateral edge portions 5 which are positioned a short distance below the central part 4. The small difference in height between the central part 4 and the lateral edge portions 5 allows the foil to be supported at the edges without impeding contact between the central part 4 and the skin being shaved. Protruding from each side edge 5 of the outer foil 1 is a pair of teeth 6 defining detent notch 7 for anchoring the outer foil at a medial location along the foil as will become clear from the description that follows. The inner foil 2 is basically similar in form to the outer foil with openings 8, a raised central part 9 and lateral side edges 10. The inner foil 2 conforms closely with the outer foil 1 so that when the inner foil is reciprocated relative to the outer foil hairs penetrating through the outer foil are severed by being sheared between edges defined by the openings 3, 8 in the respective foils as these edges are moved towards and past each other. Although the openings 3, 8 in the foils are shown to be transverse slots, other shapes of foil opening can be used in the outer and/or inner foil, as is well known in the art. The inner and outer foils are both flexible and their flexibility is not detrimentally impaired by the stepped cross-sectional profile of the foils.

The foils 1, 2 are carried on a deformable supporting structure 14 mounted in a frame 15 that can be fixed within an electric razor housing. The frame has a base plate 16, a pair of stanchions 17 fixedly mounted on the base plate, and a pair of lateral guide plates 18 secured firmly to the opposite sides of the stanchions. A pair of parallel guide rails 19 extends between the stanchions 17 and slidably support a slide member 20 that forms part of the drive transmission as described further below.

The deformable foil supporting structure 14 includes a symmetrically opposed pair of unitary suspension members 22 that are disposed adjacent the respective lateral guide plates 18. Each suspension member comprises a series of upwardly directed support elements 24 interlinked adjacent their lower ends by integral hinges 25 so that the free upper ends of the support elements are able to move towards and away from the upper ends of their adjacent elements and the suspension member is deformable from the generally straight configuration shown in FIGS. 1-4 to the concave configuration shown in FIG. 5 or the convex configuration shown in FIG. 6. At their upper ends the support elements 24 have upwardly directed abutment faces defined by shoulders 26, and slots or notches 27 immediately above these shoulders. The lateral edge portions 5 of the outer foil 1 are received slidably in these notches 27 with the middle support element 24 of each suspension member 22 being engaged in the notch 7 defined between the projecting teeth 6 of the foil 1 to retain the outer foil against longitudinal movement relative to the middle support element. Thus, as the outer foil 1 and the suspension members 22 flex concavely or convexly along their length the support elements 24 are able to slide relative to the foil, while the engagement of the middle support elements in the foil notches 7 retains the outer foil against unwanted movements relative to the supporting structure.

Integral with each of four support elements 24 disposed along each suspension member 22 are a boss 28, which is attached to the lower end of the support element, and a peg 29 which in vertical alignment with the boss 28. Axle pins (not shown) extend between the pairs of laterally opposed bosses 28 and bear respective spring members 30. The spring members have upwardly open sockets 31 into which the pegs 29 engage so that the spring members are maintained in alignment with the support elements 24 to which they are respectively connected. Each spring member has an integral resilient tongue 32 on the upper face of which is mounted a roller 33 that is freely rotatable about a transverse axis. The spring members 30, in addition to providing inner lateral support for the suspension members 22, act to urge the inner foil 2 upwardly into cooperation with the outer foil 1. More particularly the rollers 33 on the spring members having rolling contact with a guide rail 35 on the underside of a flexible driving plate 36. The inner foil 2 rests on the upper surface of the driving plate and a pair of studs 37 on this surface engage in one of the slot openings 8 of the foil so that the foil is constrained to follow reciprocal movements of the driving plate produced by the driving mechanism. The lateral edges of the driving plate 36 and the inner foil 2 are disposed above the shoulders 26 of the support elements 24 so that the driving plate and inner foil follow any flexing of the outer foil 1, and the inner foil is always urged against the underside of the outer foil over their entire length by the spring members 30.

Figure 5:
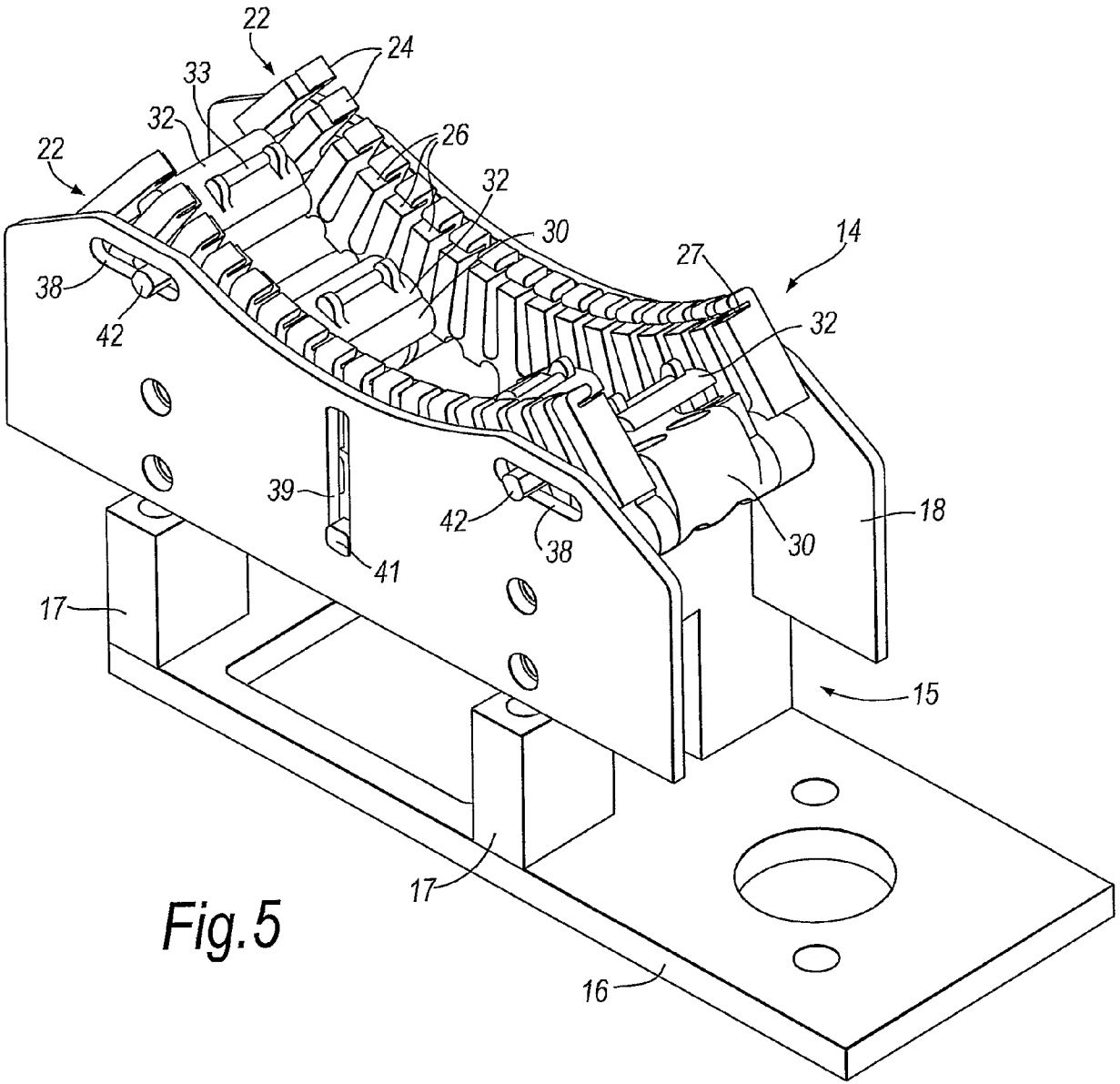
FIG. 5 is a view showing the foil supporting structure deformed into a concave shape.
Figure 6:
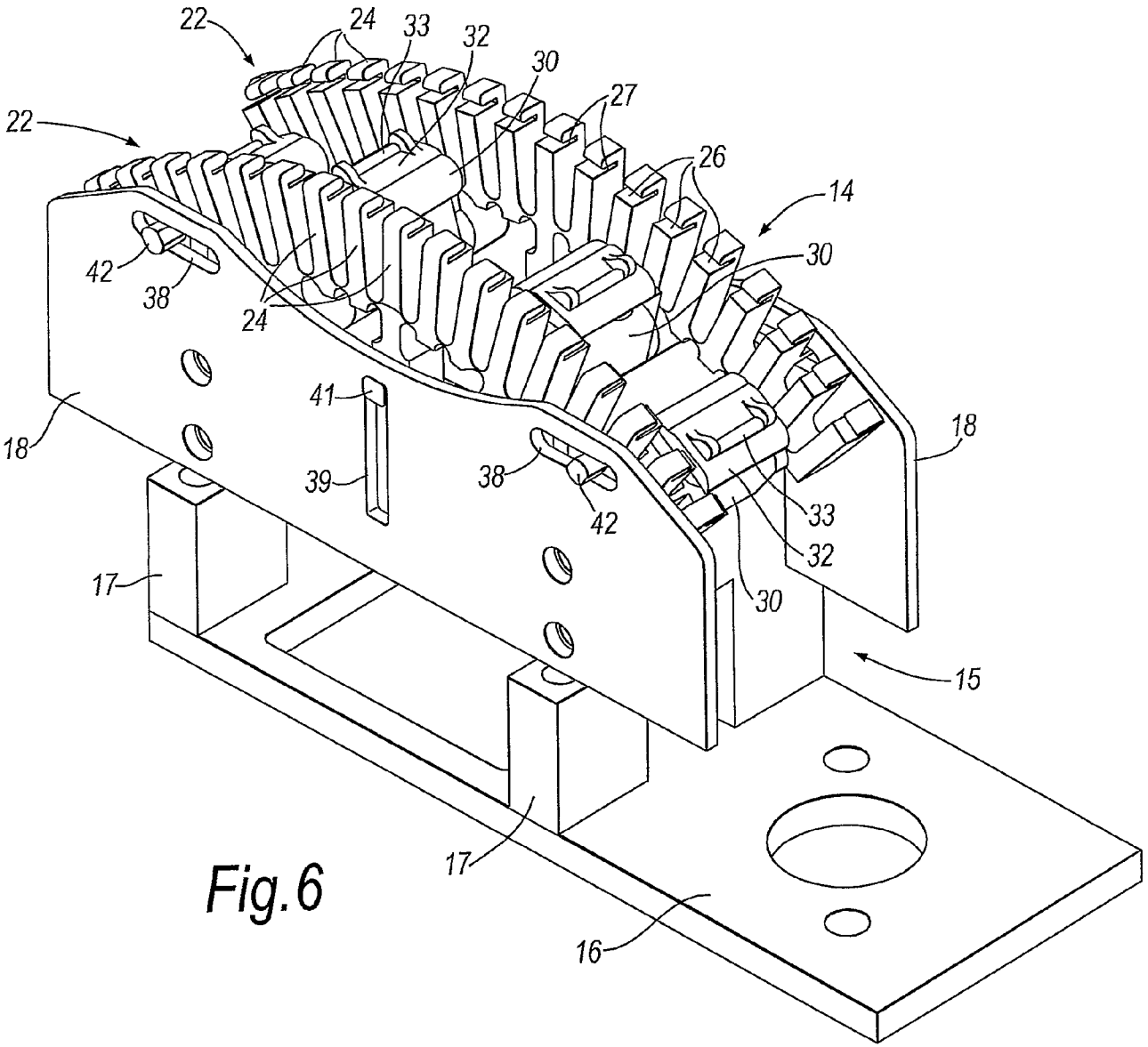
FIG. 6 is a view showing the foil supporting structure deformed into a convex shape.

The deformation of the suspension members 22 under forces imposed on the outer foil 1 is controlled by the lateral guide plates 18 each of which has a pair of longitudinally aligned guide slots 38 and a further linear guide slot 39 that extends in a direction perpendicular to the longitudinally aligned slots 38. The central support element 24 of each suspension member 22 is extended downwardly by leg 40 that is located alongside the guide slot 39 and has a projecting pin 41 slidably engaged in the slot 39 so that the central support element 24 is guided for movement in the direction of the slot 39. Respective support elements 24 adjacent the opposite ends of the suspension member 22 have integral guide pins 42 that project laterally and engage slidably in the guide slots 38. The arrangement of the guide slots 38, 39 and pins 41, 42 ensures that the suspension members 22 and hence the outer and inner foils 1, 2 supported by them always adopt a smooth uniform curvature when displaced from the normal straight configuration due to a force imposed against the outer foil. A force directed at the central region of the outer foil, e.g. when the foil is pressed against a convex skin contour will result in the foils 1, 2 and the deformable support structure 14 adopting a concave form, e.g. as depicted in FIG. 5, whereas a force directed at the ends of the outer foil, as may occur when it is pressed against a concave skin contour will cause the foils 1, 2 and their supporting structure 14 to assume a convex curvature as depicted in FIG. 6.

The drive system for reciprocating the inner foil 2 includes an electric motor 42 having an output shaft 43 with an eccentric end cam 44 which is coupled to the slide member 20 by a drive rod 45. The slide member 20 is coupled to the driving plate 36 by a telescopic arm 47 that includes a pair of parallel pins 48 and a clevis member 49 having a pivotal connection to a connector fixed on the underside of the driving plate 36. At least one of the clevis member 49 and the slide member 20 has a telescopic sliding connection with each of the pins 48 so that the clevis member 49 is free to move towards and away from the slide member 20 in order to follow movements of the flexible driving plate 36 due to the foils 1, 2 and their supporting structure 14 flexing. It will be understood that in response of rotation of the motor output shaft 43 the slide member 20 is reciprocated back and forth on the guide rails 19. Thereby the arm 47 is reciprocated and driving plate 36 is also driven with a reciprocating motion although it will always follow the curvature of the suspension members 22 and hence the foils 1, 2. The inner foil 2 is moved with the driving plate due to the studs 37 and thereby the inner foil is reciprocated relative to the outer foil 1 while being maintained in close cooperation with the outer foil for shearing hairs regardless of any longitudinal flexing of the foils.

The described razor assembly is capable of conforming to skin contours ensuring shaving contact over a large skin area even when fairly sharp curvatures, such as in the region of a jawbone are encountered, and as a result an improved shaving efficiency can be achieved. The ability of the outer and inner foils to flex to conform to the skin contours during shaving is enhanced by the foils being supported by the deformable structure 14 independently of the driving transmission that imparts relative movement between the foils for severing hairs.

It should be understood that the foregoing description of the preferred embodiment is given by way of non-limiting example only and that modifications and variations are possible without departing from the scope of the invention as defined by the claims which follow.

LIST OF REFERENCE NUMERALS

1. Outer foil
2. Inner foil
3. Foil openings
4. Central foil part
5. Edge foil portion
6. Detent teeth
7. Detent notch
8. Foil openings
9. Central foil part
10. Foil edges
14. Deformable supporting structure
15. Frame
16. Baseplate
17. Stanchions
18. Guide plates
19. Guide rails
20. Slide member
22. Suspension members
24. Support elements
25. Integral hinges
26. Shoulders
27. Notches
28. Boss
29. Peg
30. Spring member
31. Socket
32. Resilient tongue
33. Roller
35. Guide rail
36. Driving plate
37. Studs
38. Guide slot
39. Guide slot
40. Leg
41. Pin
42. Motor
43. Output shaft
44. End cam
45. Drive rod
47. Telescopic arm

48. Pins
49. Clevis member

The invention claimed is:

1. An assembly for an electric razor, comprising an elongate flexible outer foil (1), the outer foil having openings (3) to allow hairs to penetrate the foil, and a flexible inner foil (2) cooperating with and reciprocable relative to the outer foil for shearing hairs penetrating the outer foil, characterized in that the inner and outer foils (1, 2) are carried on a supporting structure (14) that is deformable to permit the foils to flex, and the supporting structure includes a pair of unitary suspension members (22) and each suspension member (22) comprises a series of upwardly directed support elements (24) interlinked adjacent their lower ends by integral hinges (25) providing free upper ends wherein the free upper ends of the series of support elements (24) are spaced apart along the foils and so linked together that the foils can flex to follow concave or convex curvatures along the length thereof.

2. An assembly according to claim 1, wherein support elements (24) are uniformly spaced apart along the foils (1, 2).

3. An assembly according to claim 1, wherein the support elements (24) are linked together by hinged connections (25) and extend from the hinged connections to free ends, the foils being supported at the free ends of the elements.

4. An assembly according to claim 1 wherein there is sliding cooperation between the outer foil (1) and the supporting structure (14).

5. An assembly according to claim 4, wherein the support elements (24) have notches (27) at the free ends, and a side edge portion (5) of the outer foil (1) is received in and slidably guided by the notches.

6. An assembly according to claim 5, wherein the supporting elements (24) have shoulders (26) adjacent the notches (27) for supporting the inner foil (2) against displacement away from the outer foil (1).

7. An assembly according to any one of the preceding claims, wherein the outer foil (1) has a detent teeth (6) and corresponding detent notch (7) for engaging a support element (24) to retain the outer foil against longitudinal movement relative to the engaged element.

8. An assembly according to claim 7, wherein the detent teeth (6) and detent notch (7) is located at a medial position along the outer foil.

9. An assembly according to claim 1, wherein a flexible driving plate (36) is engaged with the inner foil (2) for reciprocating the inner foil.

10. An assembly according to claim 9, wherein the driving plate (36) and the inner foil (2) are in sliding cooperation over a major part of their length.

11. An assembly according to claim 9 or 10, wherein the driving plate (36) is drivingly coupled to the inner foil (2) at a single location along the foil.

12. An assembly according to claim 11, wherein the driving coupling between the inner foil (2) and the driving plate (36) is located at a medial position along the foil.

13. An assembly according to claim 1, wherein a guide arrangement is provided to guide relative movement of the linked support elements for controlling deformation of the supporting structure.

14. An assembly according to claim 13, wherein the guide arrangement comprises a frame (15) in which the supporting structure (14) is mounted.

15. An assembly according to claim 13 or 14, wherein at least two of the support elements (24) are guided for displacement along linear paths.

16. An assembly according to claim 15, wherein two support elements (24) are guided for movement in the longitudinal direction, and a further support element (24) is guided for movement in a direction substantially perpendicular to the longitudinal direction.

17. An assembly accordingly to claim 15, wherein the guided elements have pins (41, 42) engaged in guide slots (38, 39) formed in an adjacent frame member (18).

18. An assembly according to claim 1 wherein the supporting structure (14) includes at least one spring (30) acting on the inner foil (2) to urge the inner foil against the outer foil.

19. An assembly according to claim 18, wherein a plurality of spring members (30) are arranged to act on the inner foil (2) at positions spaced apart along the inner foil.

20. An assembly according to claim 19, wherein the spring members (30) are supported by respective support elements (24) of the series of linked foil supporting elements.

21. An assembly according to claim 19, wherein the spring members (30) carry a roller (33) and act on the inner foil through the roller.

22. An assembly according to claim 1, wherein the series of linked support elements (24) supports the foils along one lateral edge portion (5) and lateral side edge portion (10), and the supporting structure includes a further series of linked support elements (24) supporting the foils along the other lateral edge portion (5) and lateral side edge portion (10).

23. An assembly according to claim 22, wherein the spring members (30) are positioned between and supported by support elements (24) of the respective series of linked elements.

24. An assembly according to claim 22, wherein each series of linked support elements (24) is symmetrical to the other series of linked foil support elements.

25. An assembly according to claim 1 wherein each series of linked support elements (24) is formed by a one piece foil suspension member (22).

26. An assembly according to claim 1, including a drive transmission for reciprocating the inner foil (2), the transmission comprising a slide member (20) guided for linear movement, and an arm (47) extending from the slide member and having an upper end coupled to the inner foil, the upper end of the arm being movable towards and away from the slide member.

27. An assembly according to claim 26, wherein the arm (47) has a sliding connection with the slide member (20) permitting movement of the arm in a direction perpendicular to the direction of linear movement of the slide member.

* * * * *